US007493792B2

(12) United States Patent
Bouchoux

(10) Patent No.: US 7,493,792 B2
(45) Date of Patent: Feb. 24, 2009

(54) CRIMPING TOOL AND DEVICE PROVIDED THEREWITH

(76) Inventor: Arnaud Bouchoux, 5 rue la Parsiflore, Conflan Saint Honorine (FR) F-78700

( * ) Notice: Subject to any disclaimer, the term of this patent is extended or adjusted under 35 U.S.C. 154(b) by 46 days.

(21) Appl. No.: 11/547,147

(22) PCT Filed: Mar. 25, 2005

(86) PCT No.: PCT/FR2005/000732

§ 371 (c)(1),
(2), (4) Date: Sep. 29, 2006

(87) PCT Pub. No.: WO2005/095015

PCT Pub. Date: Oct. 13, 2005

(65) Prior Publication Data

US 2007/0271991 A1 Nov. 29, 2007

(30) Foreign Application Priority Data

Mar. 30, 2004 (FR) ..... 04 03323

(51) Int. Cl.
*B21J 13/08* (2006.01)

(52) U.S. Cl. ..... 72/457; 72/479; 72/481.3

(58) Field of Classification Search ..... 72/413, 72/457, 458, 479, 481.1, 481.3, 392; 29/243.58
See application file for complete search history.

(56) References Cited

U.S. PATENT DOCUMENTS

| | | | | | |
|---|---|---|---|---|---|
| 3,426,573 | A * | 2/1969 | Wilson, Jr. | ..... | 72/434 |
| 3,541,836 | A * | 11/1970 | Meis | ..... | 72/479 |
| 3,777,687 | A | 12/1973 | Colman et al. | | |
| 4,060,046 | A | 11/1977 | Eckold et al. | | |
| 5,794,485 | A * | 8/1998 | Lovas | ..... | 72/458 |
| 6,439,024 | B1 * | 8/2002 | Staquet | ..... | 72/458 |
| 6,470,729 | B1 | 10/2002 | Hughes et al. | | |
| 6,609,406 | B1 | 8/2003 | Staquet | | |
| 7,343,772 | B2 * | 3/2008 | Shuckhart | ..... | 72/479 |

* cited by examiner

*Primary Examiner*—Edward Tolan
(74) *Attorney, Agent, or Firm*—McDonnell Boehnen Hulbert & Berghoff LLP

(57) ABSTRACT

The inventive crimping tool (1) comprises a pushing head (2) which contact the fold (3) of a sheet (4) and has a front convex contour (5) in a plane view and a guiding seat (6) applicable to the sheet (4), wherein the pushing head (2) and the guiding seat (6) are remote from each other and define therebetween a groove (7) bounded by faces (8, 9) which are opposite in a substantially parallel direction with respect to the pushing head and the seat. The thickness (e) of said groove (7) substantially corresponds to the thickness of parts to be crimped, the front face of the pushing head is convexly connected to said flat face delimiting the groove and the bottom (10) thereof and extends along a convex contour, in particular substantially in a parallel direction with respect to the front face (5) of the pushing head (2).

12 Claims, 3 Drawing Sheets

FIG.1
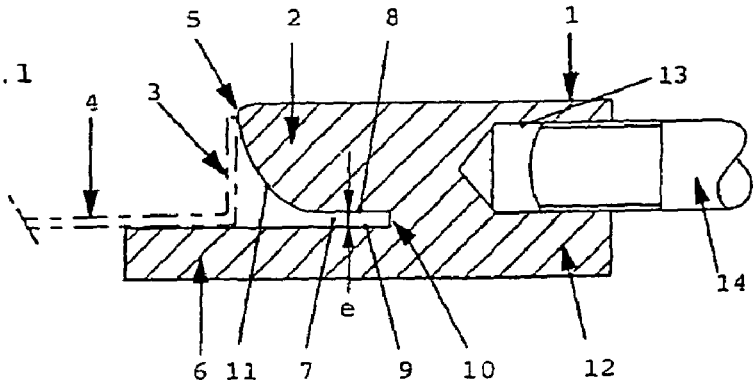
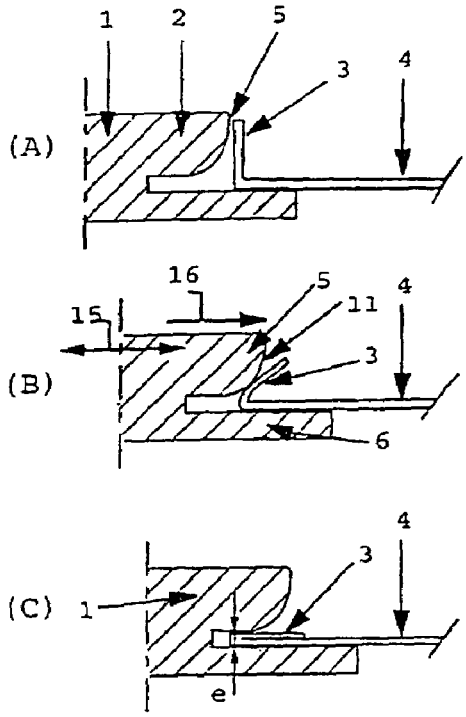
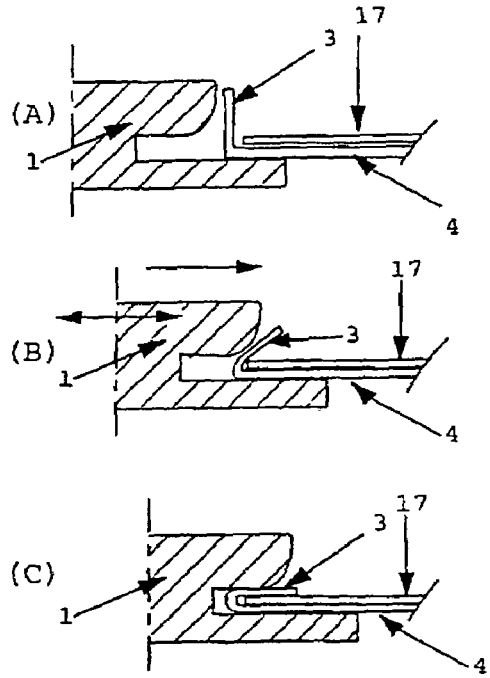
FIG.2
FIG.3
FIG.7
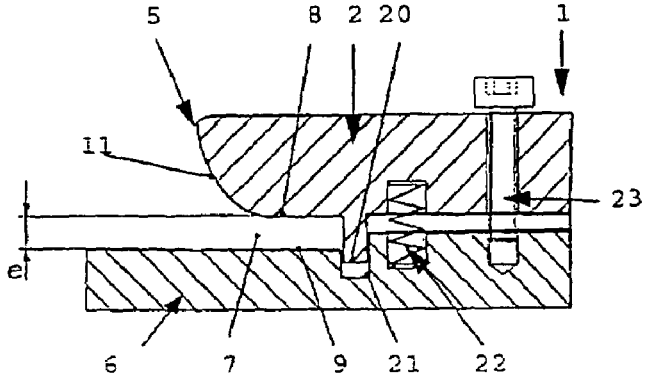

CRIMPING TOOL AND DEVICE PROVIDED THEREWITH

This application is a 35 USC 371 of PCT/FR05/00732 filed Mar. 25, 2005.

The present invention relates generally to improvements applied in the domain of crimping.

In the mechanical industry, the operations of crimping applying to parts with relatively large dimensions are performed by means of presses which fold the sheet-metal on the entire length of the part, even on the entire periphery of the part in one single operation. In this manner quick and clean crimping is done. This is the case for example in the automobile industry for fabricating openings (doors and hoods) which are obtained by crimping an external appearance or skin or sheet-metal part on an interior lining or shell.

In contrast, this kind of crimping process with a press cannot be done in a workshop, for example for doing a repair on a crimped assembly. In this case, the crimped parts are disassembled, the external appearance or sheet-metal part, for example damaged, is replaced by a new part with its edges folded at 90°, which is matched to the recovered interior lining or shell, and then a manual crimping with hammer and dolly block is done. In particular this is the manner in which doors or hoods of vehicles are currently repaired. This manner of proceeding is clearly long and disagreeable.

From the document U.S. Pat. No. 6,470,729 a crimping tool is known which includes:

- a pushing head suitable for contact with a sheet-metal hem flange and having, in plane-view, a convex front contour and
- a guiding base suitable to be applied under said sheet-metal,
- said pushing head and said guiding base being separated from each other and between them defining a receptacle delimited by the largely parallel opposing faces of the pushing head and the base, this receptacle having a thickness largely corresponding to the thickness of the parts to be crimped.

Owing to the geometry of its shapes, this known tool is ill-suited to the work for which is intended.

First, the pushing head has a front edge which is strictly perpendicular to the plane surface defining the upper side of the receptacle serving for crimping, forming a blunt angle with the latter. The result of this is that when the tool advances on the sheet-metal, this blunt angle marks the sheet-metal and it is not possible to obtain good-quality crimping.

Furthermore, the bottom of the crimping receptacle extends largely straight, largely parallel to the front edges of the pushing head or "upper projection" and the guiding base or "lower projection", and the bottom of this receptacle opens at a sharp angle on the tool's lateral faces. Owing to this, to avoid significant marking of the sheet-metal by the sharp edges of the receptacle during crimping work, the tool must be kept with its axis strictly perpendicular to the edge of the sheet-metal to be folded. What is more such marking seems even more inevitable since as indicated below this tool is a hand tool and it therefore seems impossible to assure its strictly correct positioning throughout the crimping process.

Finally, this known tool is a hand tool which is driven by a hammer. The result of this is that the crimping is performed by successive steps corresponding to the tool's width. It is therefore inevitable that marking of the sheet-metal could appear in the overlap zone from consecutive passes.

The document U.S. Pat. No. 6,609,406 also describes a crimping tool of a type similar to the preceding, but which however is laid out with a specific shape for obtaining the crimping of the edge of the sheet-metal by continuous and unidirectional movement of this tool the length of the edge of the sheet-metal which serves as its guide. Such a tool is difficult to use along a curved edge (for example, a wheel-well). Furthermore, because of the shape of this tool itself, it is necessary to begin to fold one edge of the hem flange by hammer so that the tool can be engaged and then pushed along the edge of the sheet-metal. This initiating of the folding by hammer is a heavy constraint. Furthermore, it is not possible to begin the crimping at an arbitrary location on the edge of the sheet-metal, and the work must be initiated at one end of the edge of the sheet-metal and continued right to the other end of said edge.

The purpose of the invention is therefore to propose suitable perfected means to allow performing crimping on request, for example in a workshop, in a quick and economical manner and especially with a quality of work clearly improved compared to what the current known technical solutions allow; although not exclusively, the more specific application domain is that of the automobile and in particular the repair of openings (doors and hoods) of vehicles.

For this purpose, the invention proposes a crimping tool which is characterized in that the front face of the pushing head connects convexly to the aforementioned plane face delimiting the gap and in that the bottom of the gap extends along a convex contour in particular nearly parallel to the front face of the pushing head.

Through the provisions laid-out above, the tool conforming to the invention, when it is moved transversely to the hem flange of the sheet-metal along an axial direction of the pushing head, forces the convex front face of the pushing head against the hem flange which is then progressively deformed, the contact between said convex front face and the hem flange moving progressively until reaching the plane face delimiting the gap. The folding of the hem flange is done progressively and avoids undesirable marking of the sheet-metal; at the same time, the convex shape given to the front face of the pushing head removes any risk of marking of the sheet-metal, such as scratches.

In conjunction with the preceding, the fact that the bottom of the gap extends along a convex contour, in particular nearly parallel to the front face of the pushing head, leads to the gap having a sufficient depth on its entire extent and the crimping can be done correctly even if the tool is inclined relative to the edge of the hem flange. The result of this is a greater ease of work for the worker who is not required to keep the tool strictly perpendicular to the edge of the sheet-metal at the risk of seeing the good quality of their work wiped out.

It should also be noted that the tool can engage the edge to be folded at any location of said edge, without it mandatorily involving an end. It involves a remarkable advantage because the result of it is a considerable ease of crimping an outer sheet-metal on an inner shell: it can begin by folding the hem flange of the outer sheet-metal at a central location from each of its edges, which has the effect of pinching the shell in the sheet-metal; next, without constraint, the complete crimping of each of its edges can be done.

In a preferred embodiment, the front face of the pushing head extends along a convex curve contour in particular along a convex semi-circular or semi-elliptical contour.

In a preferred embodiment, the pushing head and guiding base are made up in the form of a single unitary part with a gap of fixed thickness, such an arrangement being applicable when the sheet-metal to be crimped always has the same thickness. In a preferred implementation example, the unitary part is supported by a forked support provided with a mounting shank for its mounting in a tool holder. Just the same, it is also possible to conceive of the pushing head and guiding base as respectively made up in the form of two parts having means for guiding and joined to each other by adjustable assembly means suitable for allowing an adjustment of the thickness of the gap.

Advantageously, the pushing head and guiding base are made up of a rigid plastic, in particular of polyamide resin, the material preferably needing to have properties facilitating sliding on the sheet-metal. Otherwise, it is possible to conceive of the greasing of the parts to ease the passage of the tool and avoid marking of the sheet-metal. Additionally the synthetic material tool will avoid marking or scratching the sheet-metal. Such a tool is inert, from the electrolytic perspective, with the metals which make up the sheet-metal to be folded and is therefore compatible with aluminum sheet-metal.

According to the second of these aspects, the invention proposes a crimping tool including a tool holder supporting the crimping tool as presented above, with said tool holder arranged so that said crimping tool is driven in alternating back-and-forth movement along the pushing head's axial direction. Therefore advantageously the crimping tool includes a support shank extending along said axial direction and suitable for being held removably in a retention member, such as the tool holder's chuck or analog. In a preferred implementation, the tool holder incorporates a striking device, notably pneumatic, and the crimping tool is driven by it; in this case it is possible to call on a pneumatic striker currently available in the trade.

The provisions conforming to the invention lead to a crimping tool that is simple and low cost, but very effective and which, in conjunction with an appropriate tool holder, makes it possible to perform on request very good-quality crimping quickly and simply with very reduced costs compared to crimping by hammer currently practiced in similar cases.

The invention will be better understood through reading of the following detailed description of certain preferred embodiments given solely for purposes of purely illustrative examples. In this description, reference is made to the attached drawings in which:

FIG. 1 is a cross-sectional view of an embodiment of a crimping tool conforming to the invention.

FIGS. 2A to 2C illustrate three phases of a crimping operation carried out with the tool from FIG. 1 on simple sheet-metal.

FIGS. 3A to 3C illustrate three phases of a crimping operation carried out with the tool from FIG. 1 on sheet-metal associated with a lining.

FIG. 7 is a cross-sectional view of another embodiment of a crimping tool conforming to the invention.

Figure 8:
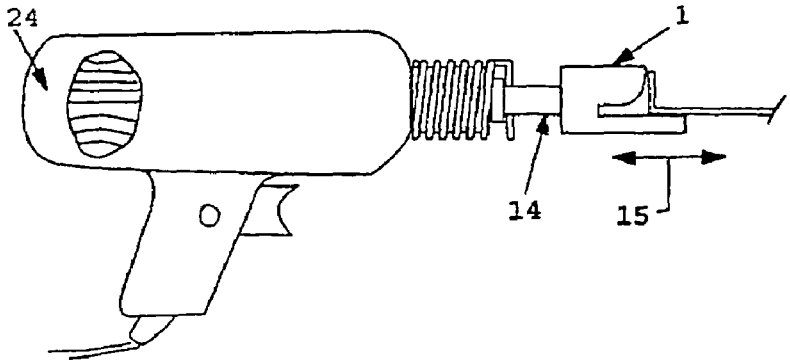

FIG. 8 schematically illustrates a crimping device laid out in conformance with the invention with a crimping tool according to the invention.

Figure 9:
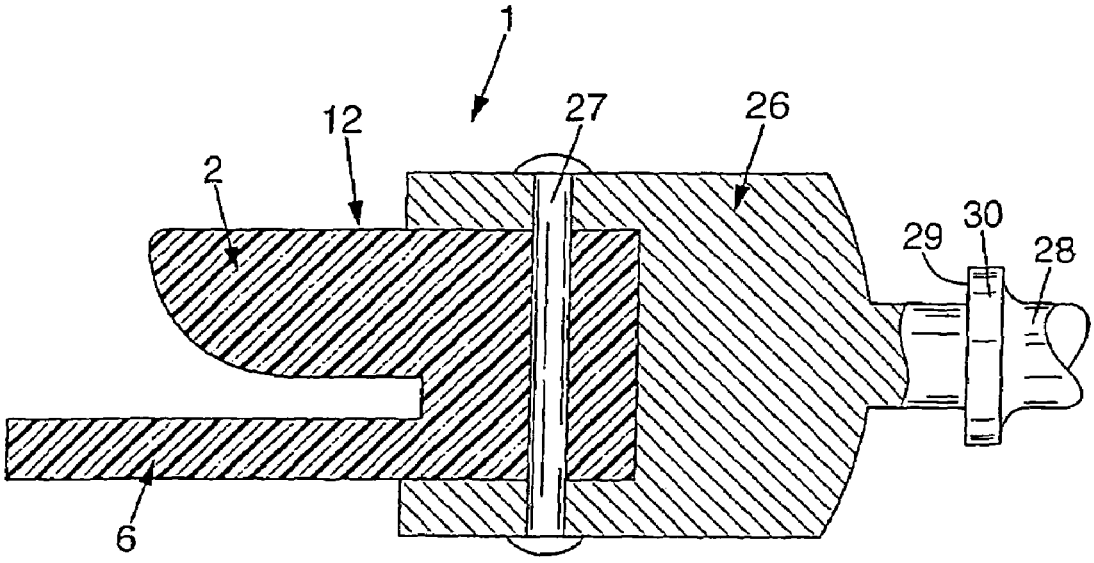

FIG. 9 is a cross-sectional view of a preferred implementation example of the tool from FIG. 1.

Now reference is first made to FIG. 1 in which is illustrated in axial cross section a crimping tool designated in its entirety by reference 1 which is arranged according to the invention.

The crimping tool 1 includes:

- a pushing head 2 which is suited for being placed in contact with a hem flange 3 of a sheet-metal 4 which has in plane-view a convex front contour 5 which will be covered in more detail below;
- a guiding base 6 suitable to be applied under said sheet-metal 4,
- said pushing head 2 and said guiding base 6 being separated from each other and between them defining a gap 7 delimited by the largely parallel opposing faces 8 and 9 belonging respectively to the pushing head 2 and the guiding base 9, this gap 7 having a thickness e largely corresponding to the total thickness of the parts to be crimped and the bottom 10 of the gap extending along a convex contour which, in particular, is largely parallel to the convex front contour 5 of the pushing head 2;
- the front face 5 of the pushing head 2 connects convexly, preferably a convex curve, in particular a circular arc, at 11 to the aforementioned plane face 8 delimiting the gap 7.

The FIG. 1 illustrates a preferred embodiment of the crimping tool 1 according to which the pushing head 2 and the guiding base 6 are implemented in the form of a unitary part 12. This part can be made up of any rigid material, metallic (for example in steel) or preferably of hard plastic such as a polyamide resin (for example "Nylon") which is lighter and less costly and which especially slides easily on the sheet-metal without marking it.

Simply, the part 12 can, as shown in FIG. 1, be provided with a bore 13 tapped to receive by, for example autolocking screwing, a shank 14 with threaded end intended for its mounting on a device like the one that will be explained later.

FIG. 2 illustrates the three phases of a crimping operation of simple sheet-metal 4. In FIG. 2A, the crimping tool is brought up to the sheet-metal 4, the pushing head 2 pressing against a hem flange 3 of the sheet-metal 4 and the guiding base 6, which is noticeably longer than the pushing head 2, presses against the sheet-metal 4. Next the tool 1 is driven with a back-and-forth axial movement (double arrow 15) at the same time as it is moved towards the sheet-metal (arrow 16) such that the hem flange 3 is progressively folded as illustrated in FIG. 2B. During this double movement, the pressing contact of the pushing head 2 against the hem flange 3 moves progressively along the concave face 11 and the fold of the hem flange 3 progressively engages the inside of the gap 7. Finally, as illustrated in FIG. 2C, the hem flange 3 is totally brought against the sheet-metal 4; the quality of the application of the hem flange against the sheet-metal improves as the thickness e of the gap 7 corresponds more closely to the total of the thicknesses of the hem flange 3 and the sheet-metal 4.

In the same manner, FIG. 3 illustrates a crimping operation of the sheet-metal 4 on a lining 17, where the hem flange 3 is then folded as explained above while grasping the edge of the lining 17. The thickness e of the gap 11 must therefore correspond as precisely as possible to the total of the respective thicknesses of the sheet-metal 4, the lining 17 and the hem flange 3.

Figure 4:
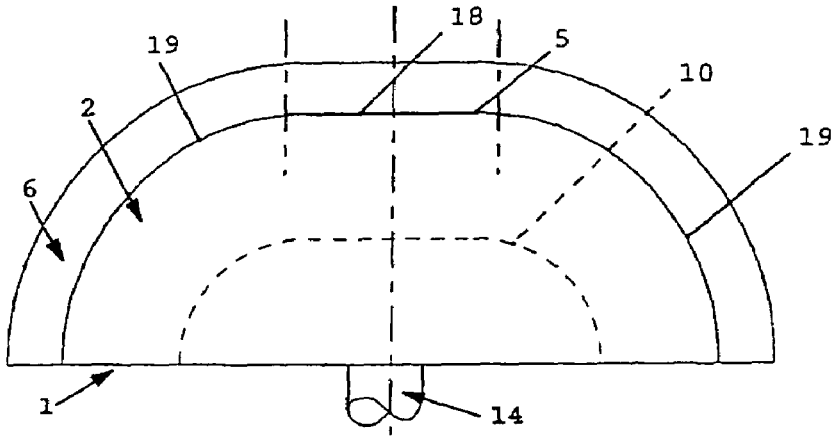
FIGS. 4 to 6 illustrate top views respectively of three possible configurations of the crimping tool from FIG. 1.
Figure 5:
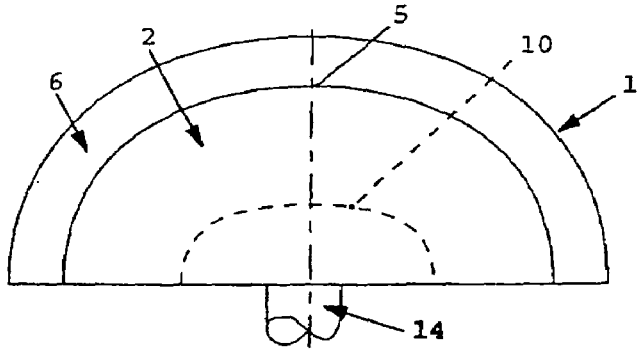
Figure 6:
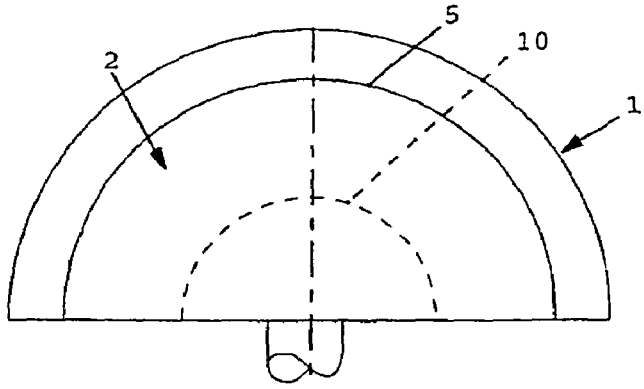

FIGS. 4 to 6 illustrate, as examples, various forms that can be given to the crimping tool 1 according to the invention. In FIG. 4, the convex front contour 5 of the pushing head 2 includes a central portion 18 largely straight connecting on either side to curved end portions 19, for example quarter circles. In FIGS. 5 and 6 are illustrated two preferred embodiments with the convex contour 5 continuously curved, in semi-elliptical shape in FIG. 5 and semi-circular shape in FIG. 6.

FIG. 7 illustrates another possible embodiment of the crimping tool 1 in which the thickness e of the gap 7 is made variable over a predetermined range of values. For this purpose, the tool 1 is made of two separate parts: one part is the pushing head 2 and the other part the guiding base 6. The two parts 2 and 6 having, behind faces 8 and 9 delimiting the gap 7, opposing surfaces with complementary respective relief (such as projections or ribs or pins 20 and notches or shoulders 21) suitable for assuring guiding of the two parts 2 and 6 during relative transverse separating or approaching movement, leading to an adjustment of the thickness e of the gap.

Between the two parts 2 and 6 elastic means such as one or more springs 22 are placed, whereas one or more screws 23 make it possible to perform the desired adjustment.

For the practical application of the crimping tool 1 in conformance with the invention under the conditions presented above concerning FIGS. 2A to 2C and 3A to 3C, use is made of a device which includes a tool holder 24 suitable for supporting the crimping tool 1, the tool holder 24 being arranged so that the tool 1 is driven by an alternating back-and-forth movement predominantly along the axial direction of the pushing head (double arrow 15). In a preferred example illustrated in FIG. 8, the tool holder 24 includes a striking device (not shown), preferably of pneumatic type; the tool holder can then be a pneumatic striker of the type currently available in automobile body repair workshops. The tool 1 is then mounted by its shank 14 provided with the appropriate shoulder, in the tool holder's support through the holding spring 25 or other analogous support member of the tool holder 24.

In FIG. 9, a preferred implementation example of the tool from FIG. 1 is shown in cross section. The unitary part 12 retains the conformation presented above in relation with FIG. 1 since here it is made up of synthetic material, preferably polyamide resin ("Nylon"). To assure a better distribution of stresses between the part 12 and the tool holder 24, mounting the part 12 in a forked support 26 is intended, which holds it by its top and bottom faces. The support can be metallic (for example steel). The unification of the part 12 and the support 26 can be obtained by means of one (or more) assembly stems 27 (bolts, pins, rivets, etc.). The support 26 is equipped with a mounting shank 28 which can be a single holder (for example coming from molding), and which is intended for mounting in a tool holder 24. For this purpose, the mounting shank 28 is provided with a skirt 30 defining the shoulder 29 suitable for cooperating with the holding spring 25 of the tool holder, for alternating driving of the tool by the tool holder 24.

The invention claimed is:

1. A crimping tool, including:

a pushing head suitable for contact with a sheet-metal hem flange and having, in plane-view, a convex front contour and a guiding base suitable to rest under said sheet-metal, said pushing head and said guiding base being separated from each other and between them defining a gap delimited by largely parallel opposing faces of the pushing head and the base, said gap having a thickness substantially corresponding to the thickness of the parts to be crimped, wherein said pushing head has a frontal face which connects convexly to said plane face delimiting said gap, and wherein said gap has a bottom which extends along a convex contour, in particular substantially parallel to a front face of said pushing head.

2. The crimping tool as claimed in claim 1, wherein said front face of said pushing head extends along a convex contour which is curved.

3. The crimping tool as claimed in claim 2, wherein said front face of said pushing head extends along a convex contour which is substantially semi-circular or semi-elliptical.

4. The crimping tool as claimed in claim 1, wherein said pushing head and said guiding base are made up in the form of a single unitary part, with said gap having a given thickness.

5. The crimping tool as claimed in claim 4, wherein said unitary part is supported by a forked support provided with a mounting shank for its mounting in a tool holder.

6. The crimping tool according to claim 1, wherein said pushing head and said guiding base are respectively made up in the form of two parts having guiding means and connected to each other by adjustable assembly means suitable for allowing an adjustment of the thickness of said gap.

7. The crimping tool as claimed in claim 1, wherein said pushing head and said guiding base are made up of a rigid plastic.

8. The crimping tool as claimed in claim 7, wherein said pushing head and said guiding base are made up of a polyamide resin.

9. A crimping device, including a tool holder supporting a crimping tool as claimed in claim 1, said tool holder being arranged so that said crimping tool is driven in alternating back-and-forth movement along an axial direction of said pushing head.

10. The crimping device as claimed in claim 9, wherein said crimping tool includes a support shank extending along said axial direction and suitable for being held removably in a holding member of said tool holder.

11. The crimping device as claimed in claim 9, wherein said tool holder includes a hammer device, and wherein said crimping tool is driven by said hammer device.

12. The crimping device as claimed in claim 11, wherein the a hammer device, is a pneumatic hammer device.

* * * * *